US010556650B2

(12) United States Patent
Longman et al.

(10) Patent No.: US 10,556,650 B2
(45) Date of Patent: Feb. 11, 2020

(54) MULTI-LINK SUSPENSION FOR MULTI-HULLED VESSELS

(71) Applicant: Nauti-Craft Pty Ltd, Dunsborough, Western Australia (AU)

(72) Inventors: Michael James Longman, Dunsborough (AU); Richard Monk, Yalyalup (AU)

(73) Assignee: Nauti-Craft Pty Ltd, Dunsborough, Western Australia (AU)

( * ) Notice: Subject to any disclaimer, the term of this patent is extended or adjusted under 35 U.S.C. 154(b) by 0 days.

(21) Appl. No.: 16/081,974

(22) PCT Filed: Mar. 3, 2017

(86) PCT No.: PCT/AU2017/050187
§ 371 (c)(1),
(2) Date: Sep. 4, 2018

(87) PCT Pub. No.: WO2017/147658
PCT Pub. Date: Sep. 8, 2017

(65) Prior Publication Data

US 2019/0092435 A1 Mar. 28, 2019

(30) Foreign Application Priority Data

Mar. 4, 2016 (AU) ..... 2016900811
Jul. 4, 2016 (AU) ..... 2016902629

(51) Int. Cl.
*B63B 1/14* (2006.01)
*B63B 39/00* (2006.01)

(52) U.S. Cl.
CPC ..... *B63B 39/00* (2013.01); *B63B 1/14* (2013.01); *B63B 2001/145* (2013.01)

(58) Field of Classification Search
CPC ..... B63B 1/14; B63B 39/00; B63B 2001/145
See application file for complete search history.

(56) References Cited

U.S. PATENT DOCUMENTS 4,730,570 A * 3/1988 Harris ..... B63B 1/14 114/123
5,228,404 A * 7/1993 Gibbs ..... B63B 1/14 114/283

(Continued)

FOREIGN PATENT DOCUMENTS

CN 201999173 10/2011
FR 2450192 9/1980

(Continued)

OTHER PUBLICATIONS

International Search Report for Application No. PCT/AU2017/050187 dated Mar. 31, 2017 (3 pages).

*Primary Examiner* — S. Joseph Morano
*Assistant Examiner* — Jovon E Hayes
(74) *Attorney, Agent, or Firm* — Michael Best & Friedrich LLP

(57) ABSTRACT

A suspension system for a water craft, the water craft including a chassis which is at least partially suspended above or relative to at least a first hull and a second hull. The suspension system includes a first hull locating arrangement for at least partially constraining the first hull in a lateral, a yaw, a roll and a longitudinal direction relative to the chassis, the first hull locating arrangement comprising a first, a second, a third and a fourth link arranged to directly or indirectly connect between the hull and the chassis. The first, second and third links each extend in at least a lateral direction relative to the chassis and contribute to a lateral constraint on the first hull relative to the chassis. The second link is longitudinally spaced from the first link relative to the chassis to contribute to a hull yaw constraint on the first hull relative to the chassis. The third link is vertically spaced from the first and/or second link to contribute to a hull roll constraint on the first hull relative to the chassis. The fourth link extends in at least a longitudinal direction relative to the (Continued)

chassis to at least contribute to a longitudinal constraint on the first hull relative to the chassis and may be adjustable in length to vary the lateral spacing between the first and second hulls and thereby vary the overall width of the vessel.

27 Claims, 9 Drawing Sheets

(56) References Cited

U.S. PATENT DOCUMENTS

| | | | | |
|---|---|---|---|---|
| 5,277,142 | A * | 1/1994 | Connor | B63B 1/14 114/283 |
| 6,176,190 | B1 * | 1/2001 | Ozga | B63B 1/14 114/272 |
| 7,314,014 | B2 | 1/2008 | Heyring et al. | |
| 7,316,595 | B2 * | 1/2008 | von Wolske | B63B 39/061 440/55 |
| 8,408,155 | B2 | 4/2013 | Sancoff et al. | |
| 9,272,753 | B2 * | 3/2016 | Heyring | B63B 1/14 |
| 2010/0000454 | A1 * | 1/2010 | Grenestedt | B63B 1/14 114/61.15 |
| 2013/0213288 | A1 * | 8/2013 | Hall | B63B 1/14 114/283 |

FOREIGN PATENT DOCUMENTS

| | | |
|---|---|---|
| GB | 2397556 | 7/2004 |
| JP | 2002193181 | 7/2002 |
| WO | 2013126583 | 8/2013 |

* cited by examiner

MULTI-LINK SUSPENSION FOR MULTI-HULLED VESSELS

TECHNICAL FIELD

The present invention relates to multi-hulled water craft and specifically relates to the location of a movable hull.

BACKGROUND

Marine vessels including multiple hulls can include suspension for locating and controlling the position of at least one of the hulls relative to the chassis or body portion. For example, U.S. Pat. No. 7,314,014 discloses a water craft having a body portion suspended above four hulls, each hull being located relative to the body portion by a single wishbone suspension linkage arrangement.

U.S. Pat. No. 5,228,404 discloses a trimaran where the chassis is supported above three hulls, each being movable relative to the chassis. The three hulls comprise a left hull, a right hull and a rear central hull, all three hulls being interconnected by a lateral bar about which they are individually pivoted. The rear centre hull has two laterally spaced rearward trailing arms and a forwardly spaced central trailing arm, all three trailing arms being parallel and having substantially the same length to maintain the rear centre hull horizontal relative to the chassis, since the rear centre hull also contains the propulsion means for the vessel. The front and rear of each of the laterally spaced (left and right) side hulls has a respective support arrangement. Each front and rear support arrangement comprises a long lateral arm between the chassis and the respective side hull and a short lateral arm between the chassis and the centre of the long lateral arm. The chassis end of the long lateral arm can slide along lateral tracks on the chassis acting against a spring and damper, the respective arrangement thereby providing resilient, damped support of the chassis above the respective end of the respective hull together with maintaining the lateral location of the side hull under the chassis mounting position of the short lateral arm.

U.S. Pat. No. 9,272,753 discloses a catamaran having a suspension geometry of a front leading arm and a rear slider for each hull to provide the required lateral, longitudinal, yaw and roll location of the respective hull relative to the chassis or body portion, leaving the hull free to move in the heave and pitch modes relative to the chassis. Heave motions relative to the chassis of the left hull in an opposition direction to the right hull is the roll mode of the suspension system. Similarly pitch motions relative to the chassis of the left hull in an opposite direction to the right hull is the warp mode of the suspension system.

However with such marine vessels having a chassis or body portion at least partially suspended relative to multiple hulls, regardless of whether the chassis engages the water or not, there is a design compromise in the width of the vessel between the hulls being laterally spaced wide apart for passive roll stiffness and the hulls being laterally spaced close together to make the vessel footprint narrow for negotiating confined spaces such as ports or marinas and/or for transportation on a trailer.

The trimaran disclosed in U.S. Pat. No. 4,730,570 has left and right hulls mounted on cross beams that can be moved laterally to vary the beam (i.e. the track or width) of the vessel, but without changing vessel height and without providing for any suspension motion to accommodate resilient supports.

The catamaran in U.S. Pat. No. 5,277,142 uses pairs of upper and lower unequal length lateral swing arms to reduce the width or beam of the vessel by swinging the left and right hulls under the chassis, which raises the chassis while reducing the track or lateral spacing between the side hulls.

In U.S. Pat. No. 8,408,155 the left and right hulls are also not able to move resiliently relative to the chassis, but are mounted to the chassis by swing arms to enable the chassis to be raised to improve the clearance of the chassis to the waves. However, the lateral spacing between the hulls is decreased when the chassis is raised, which is an undesirable combination for stability. Chinese registered utility model number 201999173 discloses a similar arrangement where each side hull of a catamaran is fixed to a swing arm that rotates relative to the chassis to both raise the chassis and decrease the lateral spacing between the hulls, or conversely to lower the chassis and increase the lateral spacing of the hulls and the vessel width. Both of these two inventions lower the vessel centre of gravity and simultaneously widen the spacing between the left and right hulls for improved stability when operating at speed. However vessel speed can be limited by wave impacts, so the rougher the sea state the larger the requirement for the height under the chassis.

Japanese patent application publication number 2002193181 discloses a planing type high speed vessel which has a chassis or body portion supported above hydrofoils resiliently mounted on the ends of extending rams or linkages to enable the height of the body portion above the hydrofoils to be increased. As the height of the body portion is increased relative to the hydrofoils, the width (i.e. lateral spacing) between the hydrofoils also increases. However there is only one suspension locating linkage for each hydrofoil to locate it relative to the body portion which does not provide a strong control of the yaw of the hydrofoil relative to the body portion.

SUMMARY OF INVENTION

According to a first aspect of the invention there is provided a suspension system for a water craft, the water craft including a chassis and at least a first hull and a second hull, the suspension system including a first hull locating arrangement for at least partially constraining the first hull in a lateral, a yaw, a roll and a longitudinal direction relative to the chassis; the first hull locating arrangement comprising a first, a second, a third and a fourth link arranged to directly or indirectly connect between the hull and the chassis; the first, second and third links each extending in at least a lateral direction relative to the chassis and contributing to a lateral constraint on the first hull relative to the chassis, the second link being longitudinally spaced from the first link relative to the chassis to contribute to a hull yaw constraint on the first hull relative to the chassis, the third link being vertically spaced from the first and/or second link to contribute to a hull roll constraint on the first hull relative to the chassis, the fourth link extending in at least a longitudinal direction relative to the chassis to contribute to a longitudinal constraint on the first hull relative to the chassis.

Also disclosed is a suspension system for a water craft, the water craft including a chassis and at least a first hull and a second hull, the suspension system including a first hull locating arrangement for at least partially constraining the first hull in a lateral, a yaw, a roll and a longitudinal direction relative to the chassis, the first hull locating arrangement comprising a first, a second, a third and a fourth link, the first, second and third links each extending in at least a lateral direction relative to the chassis, the second link being longitudinally spaced from the first link relative to the chassis, the third link being vertically spaced from the first and/or second link, the fourth link extending in at least a longitudinal direction relative to the chassis.

Each of said respective first, second, third and fourth links may be connected to the chassis by a respective chassis joint and may be connected directly or indirectly to the hull by a respective hull joint. The first and second hull joints may be longitudinally spaced. The first and second chassis joints may be longitudinally spaced. Spacing the first link longitudinally from the second link assists in providing a hull yaw constraint on the hull relative to the chassis. If the third link is vertically spaced from the first link then the third hull joint may be vertically spaced from the first hull joint and the third chassis joint may be vertically spaced from the first chassis joint. If the third link is vertically spaced from the second link then the third hull joint may be vertically spaced from the second hull joint and the third chassis joint may be vertically spaced from the second chassis joint. Spacing the third link vertically from the first and/or second link assists in providing a hull roll constraint on the hull relative to the chassis. Hull yaw is yaw of an individual hull relative to the body, as opposed to body yaw which is yaw of the body relative to the average position of all of the hulls. Similarly hull roll is roll of an individual hull relative to the body, as opposed to body roll which is effectively heave of the first hull in an opposite direction to the second hull relative to the body.

As the first, second and third links each extend in at least a lateral direction relative to the chassis, they contribute to providing a lateral constraint on the hull relative to the chassis. As the fourth link extends in at least a longitudinal direction relative to the chassis, it assists in providing a longitudinal constraint on the hull relative to the chassis. Together the first, second, third and fourth links may provide yaw, roll, lateral and longitudinal constraints on the hull relative to the chassis such that pitch and heave motions of the first hull relative to the chassis, at least within an operating range, are not constrained by the first hull locating arrangement.

The suspension system may further include variable length supports or support arrangements between the chassis and the at least two hulls for providing at least partial support of the chassis relative to the at least two hulls. At least one of said variable length supports may include a support cylinder, air spring and/or mechanical spring such as a coil spring. Alternatively or additionally, at least one of said variable length supports may be connected between the chassis and the first hull. Alternatively or additionally, at least one of said variable length supports may be connected between the chassis and one of the first, second, third or fourth links. Alternatively or additionally, at least one of said support arrangements may be connected between the first hull and one of the first, second, third or fourth links.

The variable length supports may include modal supports, interconnected to provide different stiffness rates between at least two suspension modes, such as providing roll stiffness without providing warp stiffness, or providing different pitch and heave stiffness rates. Alternatively or additionally, the variable length supports may be interconnected to facilitate active control of one or more suspension modes from roll, pitch and heave. Alternatively or additionally the variable length supports, be they independent or interconnected, may be controlled to maintain chassis attitude and/or height. Alternatively or additionally at least a front left, a front right, a back left and a back right variable length support may be provided and controlled to actively adjust at least one of the roll attitude of the chassis, the pitch attitude of the chassis, the height of the chassis relative to the hulls or the warp forces in the variable length supports.

At least one of said chassis or hull joints may provide substantially linear motion constraints and permit at least limited rotational motion. Each of said four links may include a chassis joint and a hull joint or alternatively two chassis joints of the first, second, third or fourth chassis joints may be combined or the fourth hull joint and one of the first, second or third hull joints may be combined.

The fourth hull joint of the fourth link may be fixed to one of the first, second or third links or the chassis joint of one of the first, second or third links may be fixed to the fourth link. At least one of the first, second and third hull joints may connect the respective link to an up-stand projecting above the first hull. The, or each up-stand projecting above the first hull may be fixed to the first hull.

The fourth link may be positioned nearer to the bow of the first hull than the stern of the first hull, in which case the hull joint of the fourth link may preferably be forward of the chassis joint of the fourth link. Alternatively, the fourth link may be positioned nearer to the stern of the first hull than the bow of the first hull, in which case the hull joint of the fourth link may preferably be rearward of the chassis joint of the fourth link. If the fourth chassis joint is above the fourth hull joint at a ride height, such arrangements can provide anti-dive or anti-squat properties.

The fourth link may have a primary axis through the fourth chassis joint and the fourth hull joint. The fourth link may further include a length adjustment device for adjusting the length of the fourth link between the fourth chassis joint and the fourth hull joint, or the fourth link may be length adjustable using a length adjustment device such that a straight line distance between the fourth chassis joint and the fourth hull joint may be adjusted. The length adjustment device may be adjustable between a wide hull spacing position and a narrow hull spacing position where in the wide hull spacing position the first hull is spaced further away from a centre-line of the chassis than in the narrow hull spacing position. In the wide position the length of the length adjustment device may be less than in the narrow position. Alternatively, in the wide position, the length of the length adjustment device may be greater than in the narrow position. In the wide hull spacing position at least one of the first, second or third links may also extend in a longitudinal direction relative to the chassis. Said at least one of the first, second or third links that also extends in a longitudinal direction relative to the chassis may extend further in a lateral direction than in a longitudinal direction. Alternatively or additionally, in the narrow hull spacing position at least one of the first, second or third links may also extend in a longitudinal direction relative to the chassis. Said at least one of the first, second or third links that also extends in a longitudinal direction relative to the chassis may extend further in a lateral direction than in a longitudinal direction.

First supports may be arranged between the chassis and the first hull or any of the first, second, third or fourth links, each support being effectively connected to the chassis by a chassis mounting point and effectively connected to the hull by a hull mounting point on the first hull or on any of the first, second third or fourth links, the chassis and hull mounting points being arranged such that when adjusting the length adjustment device of the fourth link from the wide hull spacing position to the narrow hull spacing position, an inclination of each support is increased, reducing a vertical support force relative to the chassis so that a height of the chassis relative to the hulls is reduced. For example, the chassis mounting point and the hull mounting point of each support can be chosen such that as the vessel width is reduced from that of the wide hull spacing position to the narrow hull spacing position, each support becomes inclined or further inclined, providing less vertical support force so that the chassis is lowered relative to the hulls. Preferably, in the narrow hull spacing position, the chassis is lowered to a minimum or bump stop contacting height. Alternatively the chassis height may be reduced by at least 10 percent of a total suspension travel distance.

Alternatively or additionally, the fourth link may also extend in a lateral direction relative to the chassis. However in at least a wide hull spacing position, the fourth link may extend further in a longitudinal direction than in a lateral direction. Alternatively, the fourth link may extend further in a lateral direction than in a longitudinal direction, particularly, although not exclusively, when the first link extends in a longitudinal direction in addition to extending in a lateral direction. For example, the first link and the fourth link may form a wishbone shape and may be rigidly connected to each other to form a wishbone.

The fourth link of the first hull locating arrangement may be length adjustable. Adjusting a length of the fourth link may change a lateral spacing between the first hull and the second hull. Alternatively or additionally, adjusting a length of the fourth link may displace the first hull laterally and longitudinally relative to the chassis.

The suspension system may further include at least a first forward cylinder and a first rearward cylinder for providing support and/or damping forces between the first hull and the chassis. The first forward cylinder may be positioned closer to a bow portion of the first hull than the first rearward cylinder. Alternatively or additionally, the first forward cylinder may be connected between the chassis and the first link. The first forward cylinder may be connected between the chassis and a hull joint of the first link, or connected between the first hull and a chassis joint of the first link.

The first rearward cylinder may be connected between the chassis and the second link. Attractively or additionally, the first rearward cylinder may be connected between the chassis and a hull joint of the second link, or connected between the first hull and a chassis joint of the second link.

Alternatively, the suspension system may further include at least a first additional cylinder for providing support and/or damping forces between the first hull and the chassis. The first additional cylinder may be longitudinally positioned between the first forward cylinder and the first rearward cylinder. The third link may be longitudinally spaced between the first and second links.

The first additional cylinder may be connected between the chassis and the third link or the first additional cylinder may be connected between the chassis and a hull joint of the third link, or connected between the first hull and a chassis joint of the third link.

Alternatively, the fourth link may be longitudinally spaced between the first and second links. The first additional cylinder may be connected between the chassis and the fourth link. Alternatively, the first additional cylinder is connected between the chassis and a hull joint of the fourth link, or connected between the first hull and a chassis joint of the fourth link.

The suspension system may further include at least a second forward cylinder and a second rearward cylinder for providing support and/or damping forces between the second hull and the chassis.

The suspension system may further include a first forward independent support, a first rearward independent support, a second forward independent support and a second rearward independent support. The first forward, first rearward, second forward and second rearward cylinders may provide damping and/or attitude adjustment forces; and the first forward independent support, the first rearward independent support, the second forward independent support and the second rearward independent support may provide at least a portion of the support of the chassis relative to the first and second hulls. Alternatively, the first forward, first rearward, second forward and second rearward cylinders may be modal supports, providing a portion of the support of the chassis relative to the first and second hulls, being interconnected to provide different stiffness in at least two of a roll, pitch, heave and/or warp suspension modes; and the first forward independent support, the first rearward independent support, the second forward independent support and the second rearward independent support may provide a portion of the support of the chassis relative to the first and second hulls.

Alternatively, the first forward cylinder, first rearward cylinder, second forward cylinder and second rearward cylinder may each be an independent support.

The independent supports may be controlled to adjust loads or displacements of the supports in at least one of a roll, pitch, heave and/or warp suspension mode.

Alternatively, the first forward cylinder, first rearward cylinder, second forward cylinder and second rearward cylinder may each be a modal support, each modal support being directly or indirectly interconnected to at least one other modal support to thereby provide different stiffness in at least two of a roll, pitch, heave and/or warp suspension modes. The modal supports may be controlled to adjust loads or displacements of the supports in at least one of the roll, pitch, heave and/or warp suspension mode.

Another aspect of the present invention provides a water craft including the suspension system as described above.

Another aspect of the present invention provides a multi-hulled vessel or water craft including a chassis, two moveable hulls and a suspension system, the suspension system including a respective hull locating arrangement for each respective moveable hull to provide linear and rotational constraints on motion of the hull relative to the chassis (e.g. linearly in a substantially longitudinal direction and in a substantially lateral direction relative the chassis and rotationally about the roll and yaw axis of each hull), wherein one or each of the respective hull locating arrangements comprises four links, each link being connected directly or indirectly between the respective hull and the chassis, the four links consisting of a first, second, third and fourth link, each link having a body joint between the link and the body and a hull joint between the link and the hull or one of the other of the four links, the first and second links each extending in at least a lateral direction relative to the chassis, the second link being longitudinally spaced from the first link relative to the chassis, at least the fourth link extending in at least a longitudinal direction, the fourth link providing a longitudinal constraint on motion of the respective hull relative to the chassis, the first second and third links adding a lateral, a yaw and a roll constraint on motion of the respective hull relative to the chassis, such that pitch and heave motions of the respective hull relative to the chassis are not constrained.

It will be convenient to further describe the invention by reference to the accompanying drawings which illustrate aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
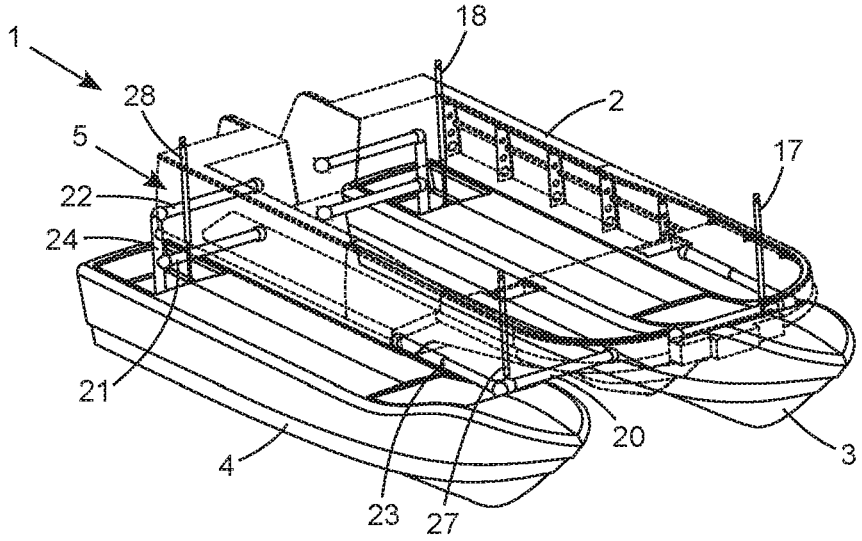
FIG. 1 is a perspective view of water craft including a suspension system according to the present invention.

Referring initially to FIG. 1, there is shown a water craft 1 having a body portion or chassis 2 shown in dashed lines and transparency to enable the left and right hulls 3 and 4 and the suspension system 5 to be more revealed.

Figure 2:
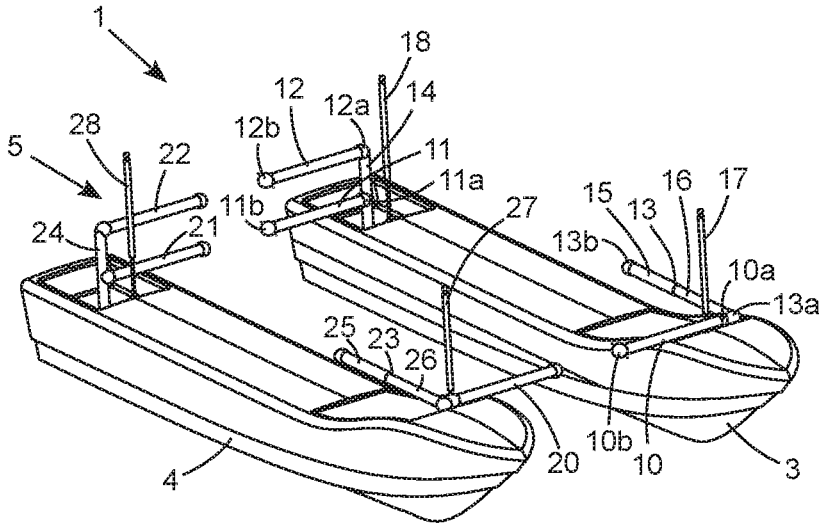
FIG. 2 is a perspective view of the hulls and suspension system of the water craft of FIG. 1.

Throughout the specification where the term chassis is used it is referring to the structure to which the hulls are located by the suspension system and can be interchangeable with the term body portion. The chassis can be a simple platform or include gunwales, a passenger cabin, cargo area. For example, as in automotive use, the chassis can be a ladder frame, or it can combine a ladder frame with a fixed cabin where the suspension loads are primarily input into the ladder frame, or it can be a monocoque where the suspension loads are input into a shell structure including the cabin. The water craft is shown at ride height, i.e. somewhere between the maximum and minimum height of the chassis above the hulls, typically between 30 and 70% of that total travel between maximum and minimum height. FIG. 2 shows the same view with the body portion or chassis 2 hidden from view entirely to improve the visibility of the components of the suspension system 5. Like components or features are assigned like reference numerals throughout the drawings.

Each hull 3 or 4 is connected to the chassis 2 by a locating arrangement comprising four links 10, 11, 12 and 13 or 20, 21, 22 and 23. The first link, which in this example is the front link 10 is connected to the hull at joint 10*a* and to the chassis at joint 10*b*. Throughout this specification, where the term joint is used it may be referring to a ball joint or other spherical joint, a resilient bushing or any other form of joint that permits at least limited rotation about at least one, two or all three mutually perpendicular axes and provides a constraint on linear motion in at least two or all three mutually perpendicular directions.

The second link, which in this example is the back link 11 is connected to the hull (in this example, via an up-stand 14 which is rigidly connected to the hull) at joint 11*a* and to the chassis at joint 11*b*. The longitudinal spacing of the front and back links 10 and 11 provides some yaw location of the hull relative to the chassis. For example, when the other links are providing stability through other constraints such as roll and longitudinal constraints on motion of the hull relative to the chassis, then the front and back links are able to provide at least some of the forces required to react yaw and lateral motions of the hull relative to the chassis. So the first and second links (the front and back links 10 and 11 in this example) at least assist in providing a yaw constraint on the hull relative to the chassis.

The third link, which in this example is the upper link 12 is connected to the hull at joint 12*a* (in this example on the same up-stand 14 as the back link 11) and to the chassis at joint 12*b*. The vertical spacing of the upper link from one or both of the front and back links provides some roll location of the hull 3 (substantially about a longitudinal or roll axis of the hull). For example, when the other links are providing stability through other constraints such as yaw, longitudinal and some lateral constraints on motion of the hull relative to the chassis, then the third link together with at least one of the front and back links are able to provide at least some of the forces required to react roll and lateral motions of the hull relative to the chassis. So the third link (the upper link 12 in this example) assists in providing a roll constraint on the hull relative to the chassis.

If the first, second and third links (in this example, the front link 10, back link 11 and upper link 12) are all of equal length, are all oriented laterally in plan view (i.e. when viewed from above) and are all oriented parallel to each other in end view (such as front view) then the hull will not roll about its primary (longitudinal) axis nor yaw relative to the chassis if the hull moves in heave mode only. Through the heave stroke of the hull there will be some lateral motion of the hull relative to the chassis, but that can be minimised by the use of long links (i.e. maximising the distance between the hull and chassis joints of each link) and/or having the links oriented horizontally at a preferred ride height or at mid stroke.

The fourth link 13 is a leading arm in this example, connected to the hull 3 at joint 13*a* and to the chassis at joint 13*b* and runs in an at least partially longitudinal direction relative to the chassis. The fourth link helps to define the longitudinal position of the hull relative to the chassis. For example, when the other links are providing stability through other constraints such as yaw, roll and lateral constraints on motion of the hull relative to the chassis, then the fourth link is able to provide at least some of the forces required to react longitudinal motions of the hull relative to the chassis. So the fourth link at least assists in providing a longitudinal constraint on the hull relative to the chassis. In this example, the fourth link 14 provides a substantially longitudinal constraint between the hull and the chassis. The use of such a forward positioned leading arm can be beneficial as it can be angled upwards as it runs backwards, i.e. the chassis joint 13*b* can be higher than the hull joint 13*a* at ride height, to assist in control of the pitch attitude of the chassis as the water craft slows or accelerates in a fore-aft direction. The four links 10, 11, 12 and 13 of the left hull locating arrangement together provide lateral, yaw, roll and longitudinal constraints on the motion of the left hull 3 relative to the chassis 2, permitting heave and pitch motions of the hull relative to the chassis. The front link 20, back link 21, upper link 22 and fourth link 23 between the right hull 4 and the body or chassis 2 similarly form a right hull locating arrangement constraining lateral, yaw roll and longitudinal motions of the hull 4 relative to the chassis 2, while permitting heave and pitch motions of the hull relative to the chassis. The back links 21 and 22 are connected to an up-stand 24 that is rigidly connected to the hull. This helps provide a vertical spacing between the upper and lower back links 21 and 22 with roll torques on the hull being reacted by compressive and tensile forces in the upper and lower links and the vertical spacing between said links.

The left leading arm 13 and the right leading arm 23 can be rigid links. Alternatively, as shown in the FIGS. 1 to 8 each fourth link 13 or 23 can be adjustable in length, for example to provide a rigid link of two different lengths such as an operating length and a storage length. Although the fourth links could be continuously adjustable, or be controlled to include three or more preset lengths, it is preferred that the fourth links are only adjusted to two lengths such as a maximum and a minimum length, which can correspond to the operating length and the storage length. As a further alternative, each link 13 or 23 can provide a limited amount of resilient length change to reduce the peak magnitude of impacts transmitted from the hull to the chassis. The links shown in FIGS. 1 to 8 are telescopically adjustable in length, having two portions, which if they are hydraulically adjustable for example, can be a bore or cylinder portion 15 or 25 and a rod portion 16 or 26.

The body or chassis 2 is supported above each of the left and right hulls 3 and 4 by longitudinally spaced supports such as the front left support or ram 17, back left support or ram 18, front right support or ram 27 and back right support or ram 28. The supports 17, 18, 27, and 28 are shown as rams and can be or include any known resilient or controllable support such as hydraulic rams, electromagnetic actuators, air springs or mechanical springs such as coil springs. Although the supports 17, 18, 27 and 28 are shown acting directly onto the hulls 3 or 4, they can be positioned between the body or chassis 2 and any of the four links or indeed additional links arranged to provide transmission of support forces ideally without providing additional locational constraints.

Figure 3:
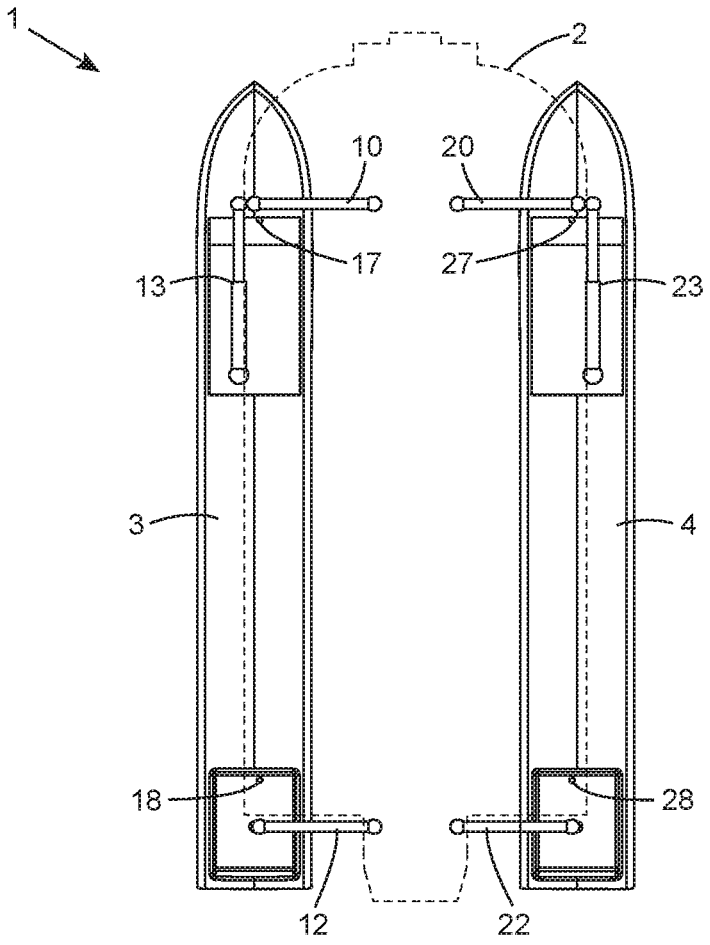
FIG. 3 is a plan view of the water craft of FIG. 1.
Figure 4:
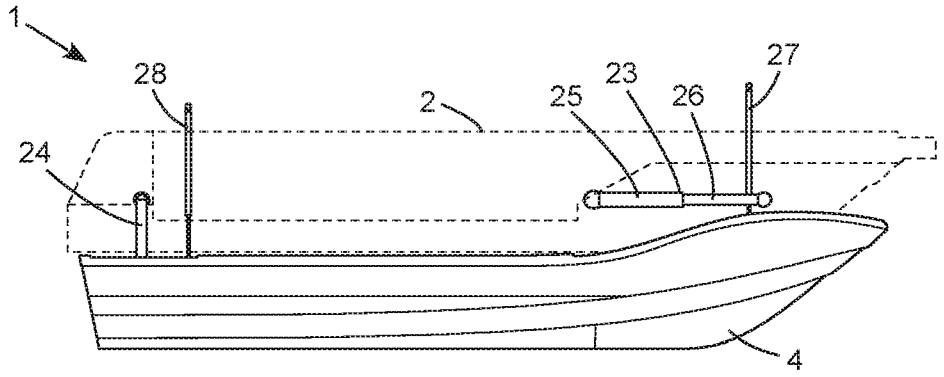
FIG. 4 is a side view of the water craft of FIG. 1.

The water craft 1 is shown in plan view in FIG. 3 with the outline of the body portion or chassis 2 shown in dashed lines. In the example shown, the front, back and upper links 10, 11, 12 or 20, 21, 22 are all similar in length and oriented substantially laterally. Although this is not necessary, it does prevent changes in the yaw and roll of the individually hulls 3 or 4 relative to the body or chassis 2. The fourth links 13 and 23 are oriented longitudinally although again this is not necessary. FIG. 4 shows a side view of the same water craft at ride height as FIGS. 1-3 and with the outline of the upper and lower portions of the chassis 2 shown in dashed lines.

Figure 5:
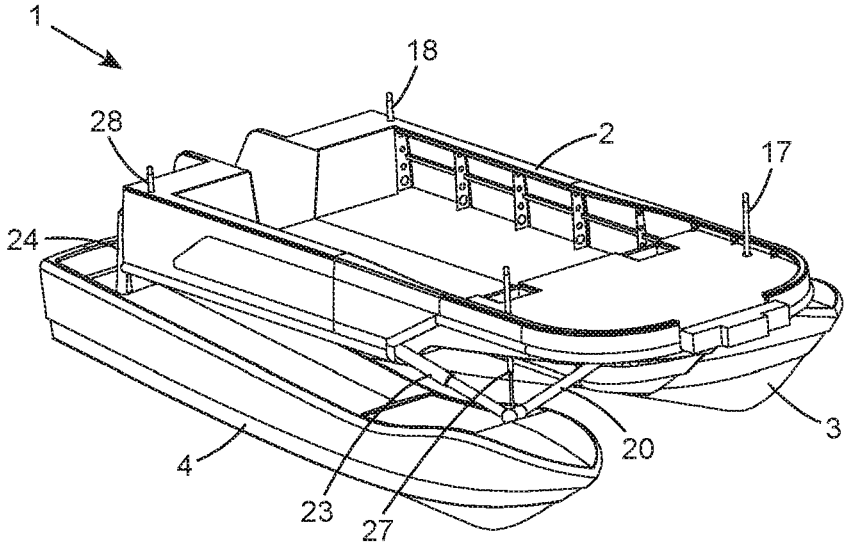
FIG. 5 is a perspective view of the water craft of FIG. 1 with the hulls articulated in the warp mode.

A chassis supported above four variable length supports can have four modes of motion: roll, pitch, heave and warp. As mentioned above, the four links locating each hull permit heave (vertical) and pitch motions of each hull relative to the chassis. Pitch motions of the left and right hulls 3 and 4 in opposite directions as shown in FIG. 5 are known as warp mode motions so the suspension system of the water craft can accommodate the warp mode. In FIG. 5 the left hull 3 is pitch nose up and the right hull 4 is pitched nose down. As with the previous Figures the mounting structures for the tops of the supports 17, 18, 27, 28 on the chassis have been omitted for clarity.

Figure 6:
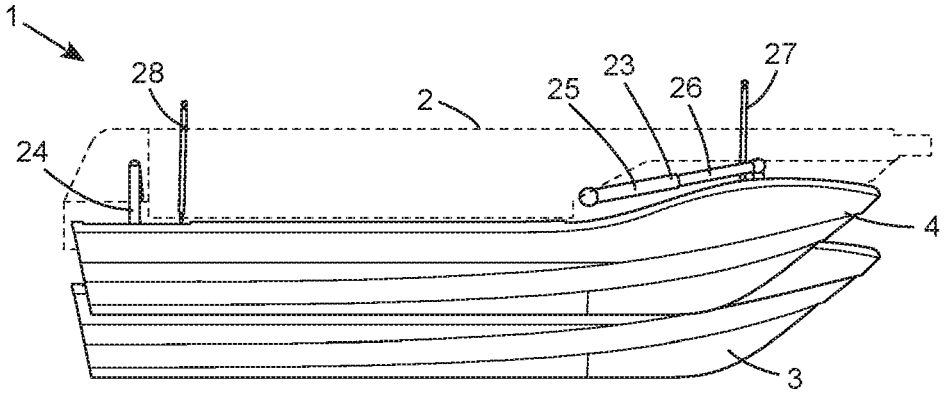
FIG. 6 is a side view of the water craft of FIG. 1 with the hulls articulated in the roll mode.

Conversely, heave motions of the left and right hulls 3 and 4 in opposite directions provides roll of the body or chassis 2 relative the hulls 3 and 4 (which is different from a roll motion of an individual hull relative to the chassis, i.e. a hull rotating about a longitudinal axis while the remainder of the water craft is fixed for example). In FIG. 6 the left hull 3 is in a fully down or extended position with the associated supports (not visible) fully extended and the right hull is in a fully up or compressed position. As the fourth link or leading arm providing longitudinal location is substantially horizontal at ride height in this example (as shown in FIG. 4) and the vertical displacement from ride height is equal and opposite from left to right for a pure roll motion, the left hull moves back slightly as the left leading arm rotates downwards and the right hull moves back a similar amount as the right leading arm 23 rotates upwards.

Figure 7:
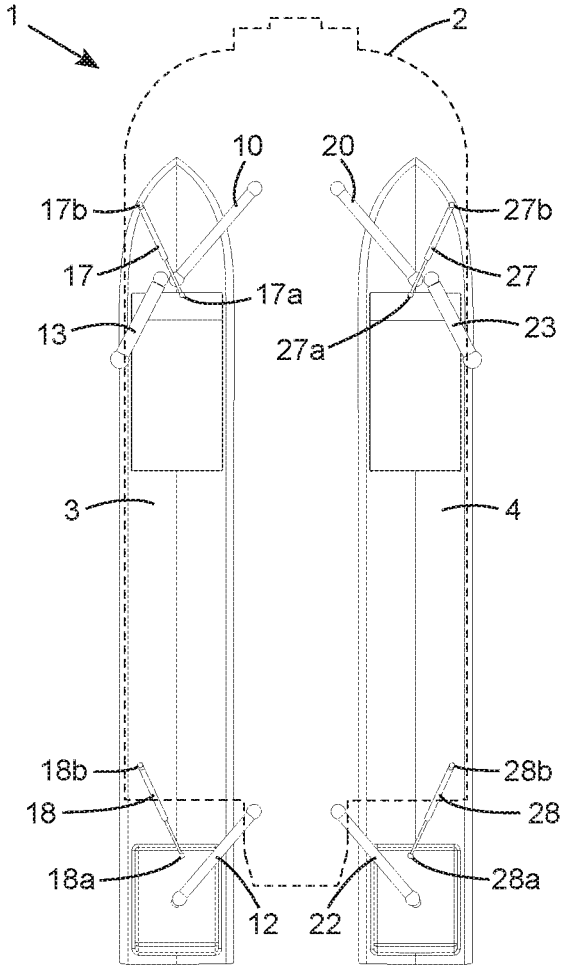
FIG. 7 is a plan view of the water craft of FIG. 1 in a narrow track configuration.

In all of the drawings so far (i.e. FIGS. 1 to 6) the fourth link has been a leading arm of unchanging length, for example a fixed length arm or an adjustable arm at an operating length, i.e. in an operational or wide track position. However, as each fourth link can optionally be adjustable in length, changing the position of the respective hull 3 or 4 relative to the chassis 2 in at least one of the suspension constraint directions is possible by adjusting the length of the fourth link. As shown in FIG. 7, when the fourth links 13 and 23 of the vessel in FIGS. 1 to 6 are adjusted to a storage length, i.e. in this example fully retracted, the hulls 3 and 4 are moved longitudinally (rearwards) relative to the chassis 2 and inwards relative to the chassis and each other. This adjustment can be done by a manually or preferably automatically controlled length adjustment device such as for example a linear actuator, or hydraulic cylinder and reduces the width of the water engaging footprint of the vessel, i.e. it reduces the track of the hulls of the water craft, reducing the lateral spacing between the hulls. Being able to adjust the track of the hulls of the water craft between a narrow width and a wide width can be useful for a number of reasons. For example, being able to adjust the track of the vessel hulls to a narrow width that ensures that the outer edges of the hulls are the same or slightly less widely spaced than the width of the chassis or body portion can be beneficial in accessing and negotiating around confined areas such as ports and marinas, to berth the vessel or to transport the vessel overland by road on a trailer. However in such a narrow width track configuration, if vessel height is maintained or even increased at sea to allow larger waves to pass under the chassis or body portion, the stability of the vessel would be reduced when compared to the same vessel with the hulls more widely spaced. Therefore, the lateral position of the hulls and the length of the adjustable length fourth links 13 and 23 in FIGS. 1 to 6 are all shown at the operating position i.e. the wide width track configuration for operating at sea. Although the operating length of the adjustable length fourth links is the fully extended length, if different joint locations are chosen, it is possible that the operating length at which the hulls are in the wide track configuration could be the fully retracted length, i.e. the storage length of the adjustable fourth links may be longer than the operating length, while the spacing between the hulls at the operating length is still greater than at the storage length. Changing between the two positions, i.e. adjusting the length of the adjustable length fourth links between the storage and operating lengths, can be controlled manually, i.e. with an operational/storage selection button, or automatically, or a combination of the two such as an operator controlled switch to indicate intention and a safety override that prevents adoption of the storage position at speed or in large sea states for example.

Rather than change between two positions, it is possible alternatively to adjust the track of the hulls in proportion to the ride height of the vessel. Many variations are possible such as adjusting the track of the hulls in proportion to a sensed height of a body portion or chassis centre of mass for example. Or the sea state may be used to determine the track, although it is more usual to use sea state to determine ride height and then in turn the ride height can optionally be used to determine the track.

Figure 8:
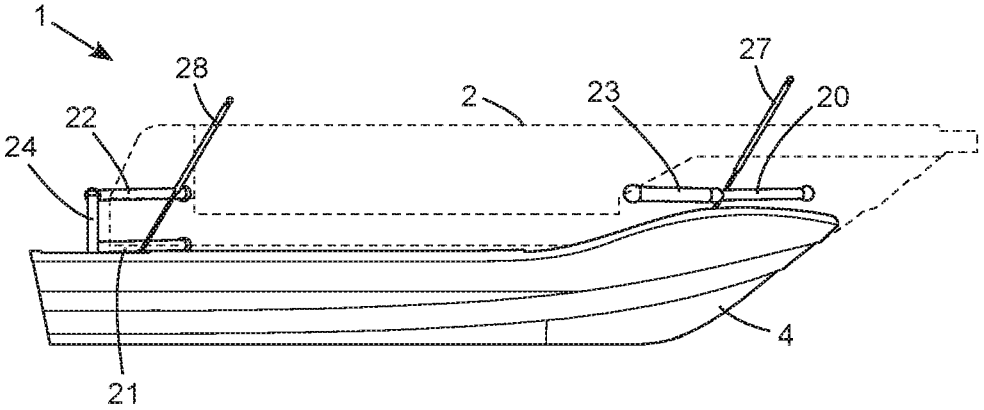
FIG. 8 is a side view of the water craft of FIG. 7.

In the example geometry shown in FIGS. 1 to 8, the supports are substantially vertically oriented rams in the wide track position of FIGS. 1 to 4 and when the fourth links 13 and 23 are then retracted to narrow the track as in FIGS. 7 and 8, the supports 17, 18, 27 and 28 become inclined due to the lateral and longitudinal displacements of the hull joints 17*a*, 18*a*, 27*a* and 28*a* relative to the chassis joints 17*b*, 18*b*, 27*b* and 28*b*. In order to maintain a constant ride height, i.e. the height of the body portion or chassis 2 above the hulls 3 and 4, then the lengths of the supports must be adjusted (increased in this case, to maintain a similar vertical distance between the hull and chassis mounts at the ends of each support) as the track of the hulls is reduced. However if the length of each support is not adjusted, or if the length of each support is maintained constant as the track is reduced, then the body portion or chassis will be lowered at least a little relative to the hulls. Similarly if the supports are the hydraulic rams of a hydraulic or hydro-pneumatic support arrangement and if no fluid is added to or removed from the support arrangement as the track is reduced, then the ride height will also be reduced. If such supports are resilient hydro-pneumatic supports, then as they are further inclined away from vertical, their lines of action also incline further away from vertical, so the linear force in the hydro-pneumatic support that is required to support the vessel is increased. Then if no fluid is added the supports will contract further lowering the body portion or chassis of the vessel. So through careful choice of geometry parameters (the coordinates of the various link and support joints to the chassis and the hulls) it is possible to ensure that the ride height increases as the track is increased and conversely that the ride height reduces as the track is reduced without having to make adjustments to the supports.

Figure 9:
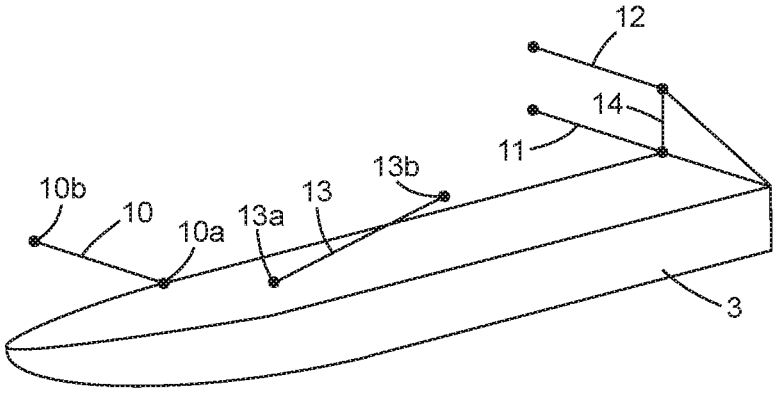
FIG. 9 is a schematic view of a variation to the hull and associated suspension system of FIGS. 1-4.

FIG. 9 shows a simplified diagram of a single hull, in this case a left hull 3 with the related suspension system 5 components. The arrangement is very similar to that in FIGS. 1 to 4, the main differences being that the hull joints are at the edge of the hull rather than towards the centre in plan view and that the leading arm or fourth link 13 is positioned further backwards, spaced from the front link 10 and inclined upwards. The fourth link is also rigid rather than adjustable in length.

Figure 10:
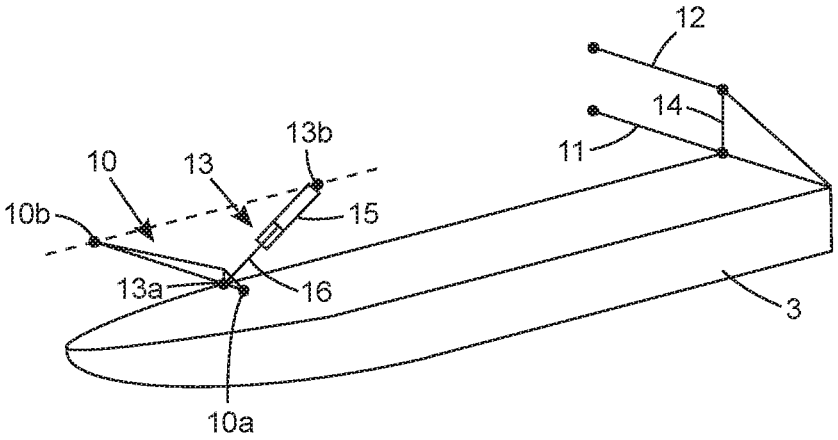
FIG. 10 is a schematic view of a variation to a hull and associated suspension system.

FIG. 10 is a modification to the arrangement of FIG. 9, the front link 10 still being horizontal and oriented laterally, but the hull joint 10*a* is inboard on the hull and the hull joint 13*a* for the adjustable fourth link 13 is fixed to the front link 10 rather than directly to the hull. In all of the preceding Figures, the upper link 12 has been the same length as and parallel to the back link 11. However, changing the length of the link (i.e. 12) that is vertically separated from the other lateral location providing links (such as 10 and 11) allows the roll attitude of the hull to be adjusted relative to the chassis as the hull is displaced vertically relative to the chassis, to provide control of camber and roll centres, as is well known in double-wishbone type automotive suspension geometries, for example.

Figure 11:
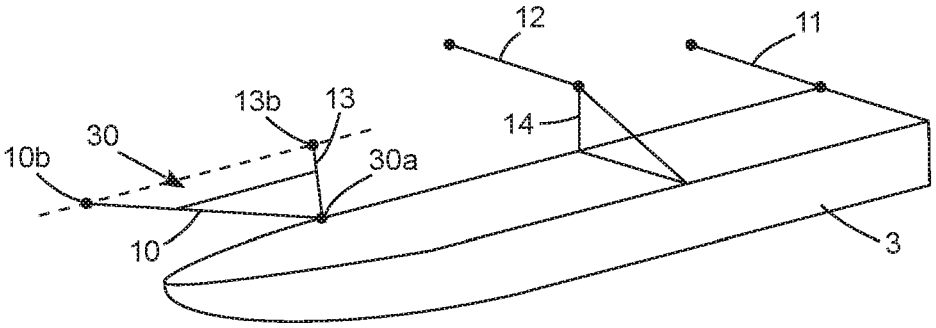
FIG. 11 is a schematic view of a further variation to a hull and associated suspension system.

In FIG. 11, the front link 10 is now angled and not oriented laterally, while the back link 11 still is oriented laterally. The fourth link 13 is still able to work with the front link 10 to provide longitudinal location of the hull 3 relative to the chassis, but if the length of the fourth link were adjusted, the hull would yaw in addition to moving laterally unless the back link 11 is similarly oriented to the front link 10 in plan view. So as in this example the fourth link is not shown as an adjustable length link, the front link 10 and the fourth link 13 are combined into a rigid A-frame or wishbone 30, both for strength and to enable the hull joints of the front and fourth links to be combined into a single hull joint 30*a*. Also in FIG. 11 the upper link is spaced longitudinally from the front and back links 10 and 11 as its longitudinal position is not critical, although affecting torsional loadings in the hull 3 and also some roll of the hull 3 can be induced through the combination of pitch and heave motions of the hull 3 relative to the chassis.

Figure 12:
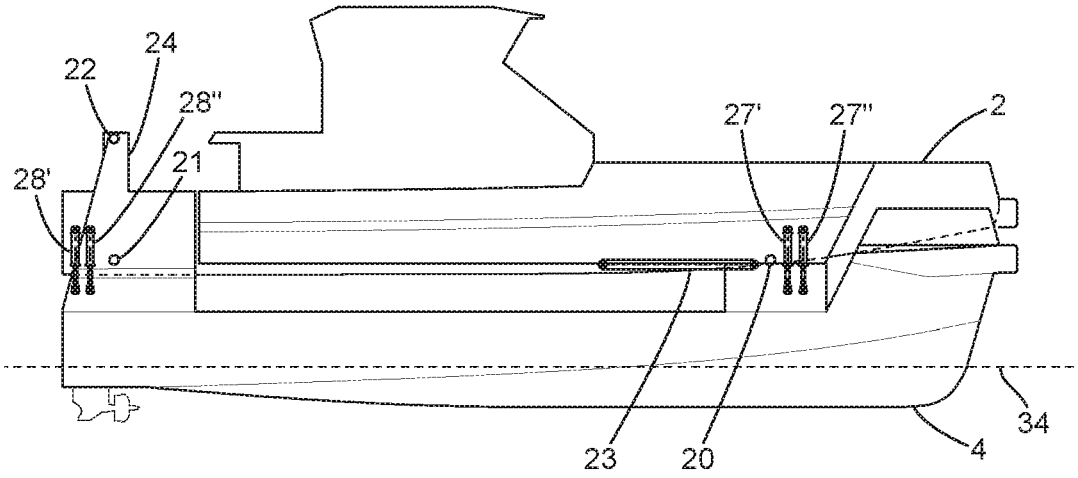
FIG. 12 is a side view of a water craft including a suspension system according to the present invention.
Figure 13:
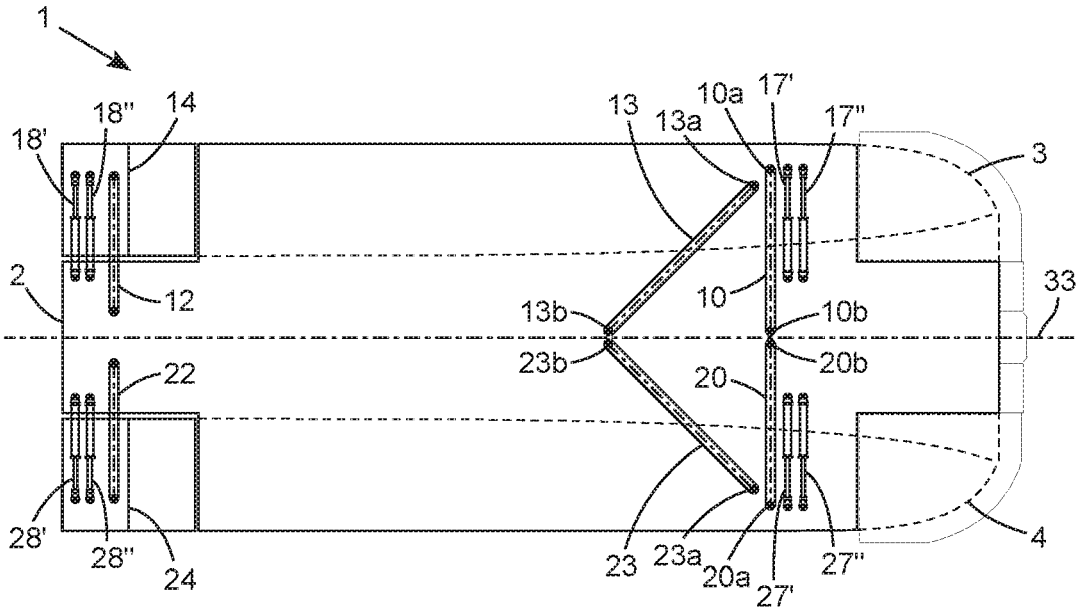
FIG. 13 is a plan view of the water craft of FIG. 12.
Figure 14:
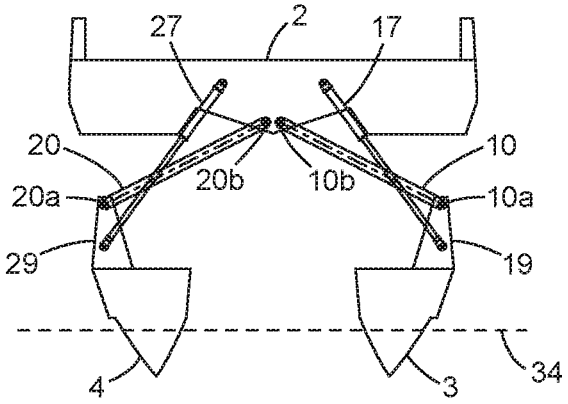
FIG. 14 is an end view of the front suspension of the water craft of FIG. 12 at full extension.
Figure 15:
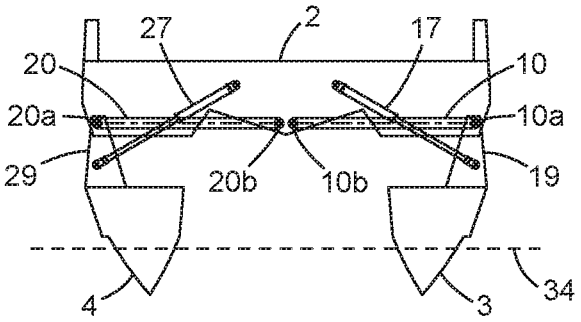
FIG. 15 is an end view of the front suspension of the water craft of FIG. 12 at a ride height.
Figure 16:
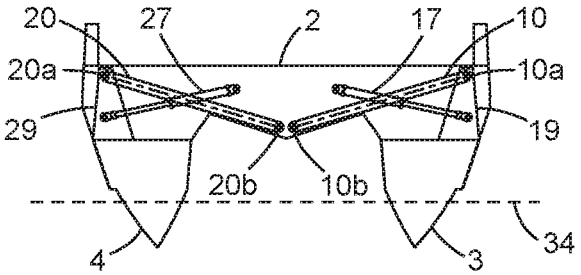
FIG. 16 is an end view of the front suspension of the water craft of FIG. 12 at full compression.
Figure 20:
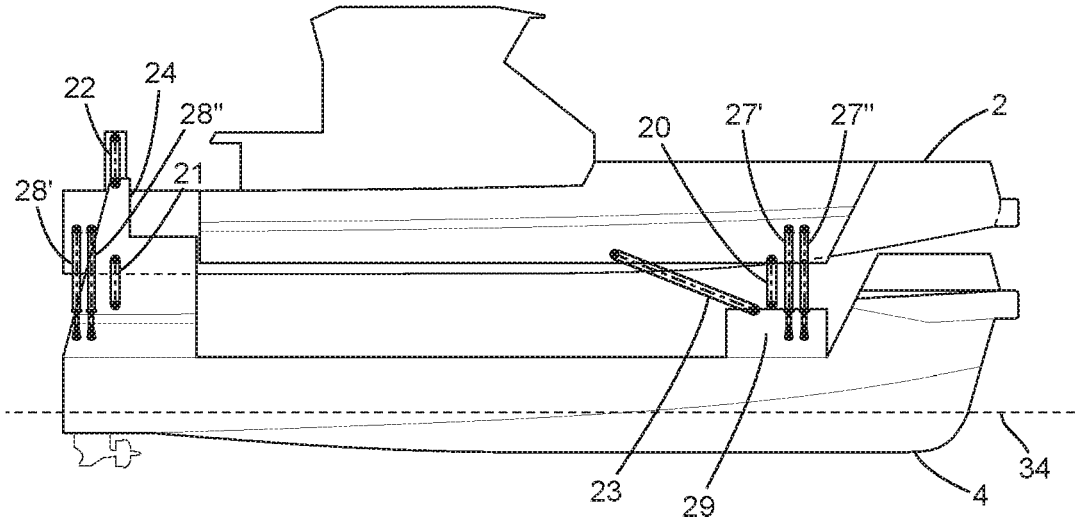
FIG. 20 is a side view of the water craft of FIG. 12 at full extension.
Figure 21:
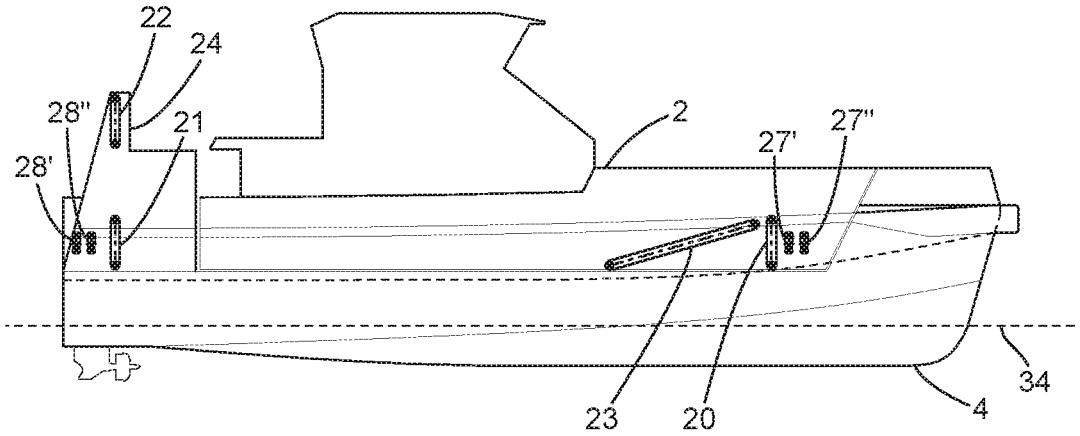
FIG. 21 is a side view of the water craft of FIG. 12 at full compression.

FIGS. 12 and 13 show a water craft at a ride height, in side and plan view respectively. FIG. 15 shows the front suspension at the same ride height and FIG. 18 shows the rear suspension at the same ride height. There can be many selectable or auto-selected ride heights depending on the conditions and other operating parameters. The same vessel is shown with the suspension at full extension in FIGS. 14, 17 and 20 and with the suspension at full compression in FIGS. 16, 19 and 21. The arrangement of upper and rear lower links 12, 22 and 11, 21, with each upper link connected to an up-stand 14, 24 is similar to that shown for the left hull in FIGS. 9 and 10 with links 11 and 12 and the up-stand 14.

Figure 17:
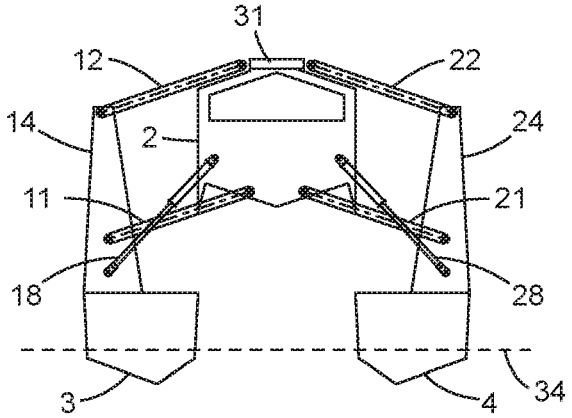
FIG. 17 is an end view of the rear suspension of the water craft of FIG. 12 at full extension.
Figure 18:
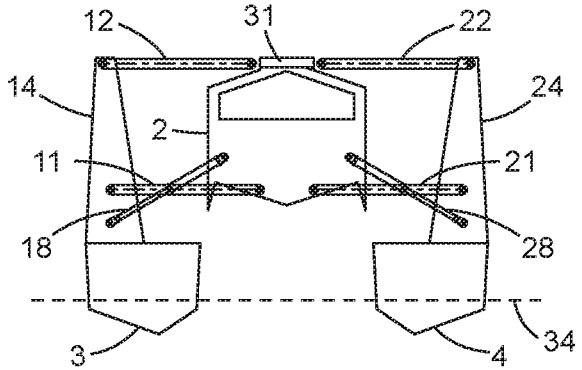
FIG. 18 is an end view of the rear suspension of the water craft of FIG. 12 at a ride height.
Figure 19:
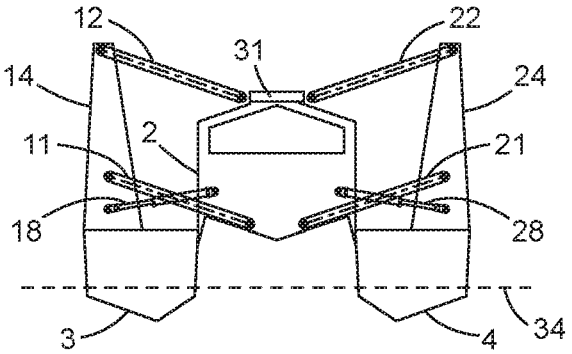
FIG. 19 is an end view of the rear suspension of the water craft of FIG. 12 at full compression.

As can be best seen in FIGS. 17 to 19, the chassis 2 of the vessel includes a structure or framework 31 to provide secure location of the upper link chassis joints 12*b* and 22*b*. The upper and rear lower link on each side, i.e. 12 and 11 on the left and 22 and 21 on the right, are parallel and of equal length, to maintain the roll attitude of the respective hull constant relative to the chassis. The length and angle of the support 18, comprising two rams 18' and 18", or support 28 comprising rams 28' and 28", defines both the motion ratio and any non-linearity of the motion ratio. That is to say, for any given pair of parallel lateral links, the relative distance between the hull and chassis joints at the ends of each support can be chosen to provide for example a motion ratio of two times from the ram to the hull, which doubles the force in the ram compared to a support that is vertical relative to the chassis. The motion ratio can vary through the travel of the suspension as the hull moves up and down relative to the chassis and the support rams contract and extend and the length and angle of each support can be chosen to provide a desirable non-linear motion ratio, for example to provide some compensation for changes in track and/or non-linear spring rates. However, the actual position of each support is not critical, so once the required length and angle is known, the support rams can be positioned by moving them vertically or laterally, without changing longitudinal position, nor length and angle, so the best packaging and/or structural arrangement can be found. For a constant roll attitude hull geometry, such as that shown at the rear, and with a front lateral link of similar length in end view, the front rams have a similar property and their position can be moved (without changing length or angle) to suit packaging requirements for example, or to align with structural members of the hulls and/or chassis to ensure an efficient design.

FIGS. 14 to 16 and FIG. 20 best show the front up-stand 19 or 29 provided to raise the hull joints of the suspension above the hull at that longitudinal position. As can be seen in FIG. 13, the geometry is a further variation on the front and fourth links 10 and 13 in FIG. 10. In FIG. 13 each front link 10, 20 is oriented substantially laterally relative to the chassis 2 of the vessel and each fourth link 13, 23 is angled so that it extends in combination of longitudinal and lateral directions. The chassis joint 13*b*, 23*b* of the fourth links are each at a similar distance from the centreline 33 of the vessel to the chassis joints 10*b*, 20*b* of the front links. However the hull joints 10*a*, 20*a* of the fourth links are on the hulls and separate to the lateral links 10, 20. The fourth links are of substantially fixed length in this example where the front portion of each hull rises significantly and would interfere with the body portion or chassis 2 or require larger allowance for motion and therefore less deck space if the fourth links had a variable length causing lateral and longitudinal motion of each hull relative to the chassis. The geometry formed by the four links constraining each hull laterally, longitudinally and in yaw and roll relative to the chassis is still suitable for use with variable length fourth links, albeit with alterations required to the shapes of the hulls and/or chassis.

In all of the disclosed geometry arrangements of four links herein, each hull is able to heave and pitch relative to the chassis, providing the left and right hulls of a catamaran incorporating such a suspension system with the ability to together move relative to the chassis in the modes of pitch, heave and warp, with the chassis being able to roll relative to the average vertical position of the left and right hulls. The waterline 34 is indicated in FIG. 12 and FIGS. 14 to 21.

The supports (such as for example 17, 18, 27, 28 in FIG. 1) can be or include, as noted previously, any known resilient or controllable support such as hydraulic rams, electromagnetic actuators, air springs or mechanical springs such as coil springs. The supports can be independent or interconnected as disclosed for example in the Applicant's international patent application publication numbers WO2011/143692 and WO2011/143694, details of which are incorporated herein by reference. For example, each of these supports can include multiple elements, such as the twin hydraulic rams 17' and 17", 18' and 18", 27' and 27", 28' and 28", in FIG. 13. Those rams can then interconnected to provide modal functionality such as a passively or inherently different stiffness in at least two suspension modes from roll, warp, pitch and heave.

Modifications and variations as would be apparent to a skilled addressee are deemed to be within the scope of the present invention.

The invention claimed is:

1. A suspension system for a water craft, the water craft including a chassis and at least a first hull and a second hull, the suspension system including a first hull locating arrangement for at least partially constraining the first hull in a lateral, a yaw, a roll and a longitudinal direction relative to the chassis, the first hull locating arrangement comprising a first, a second, a third and a fourth link arranged to directly or indirectly connect between the hull and the chassis, the first, second and third links each extending in at least a lateral direction relative to the chassis and contributing to a lateral constraint on the first hull relative to the chassis, the second link being longitudinally spaced from the first link relative to the chassis to contribute to a hull yaw constraint on the first hull relative to the chassis, the third link being vertically spaced from the first and/or second link to contribute to a hull roll constraint on the first hull relative to the chassis, the fourth link extending in at least a longitudinal direction relative to the chassis to contribute to a longitudinal constraint on the first hull relative to the chassis.

2. A suspension system as claimed in claim 1 further including variable length supports between the chassis and the at least two hulls for providing at least partial support of the chassis relative to the at least two hulls.

3. A suspension system as claimed in claim 2 wherein at least one of said variable length supports includes a support cylinder for providing support and damping forces.

4. A suspension system as claimed in claim 2 wherein at least one of said variable length supports includes an electromagnetic actuator, an air spring or a mechanical spring.

5. A suspension system as claimed in claim 2 wherein at least one of said variable length supports is connected between the chassis and the first hull.

6. A suspension system as claimed in claim 2 wherein at least one of said variable length supports is connected between the chassis and one of the first, second, third or fourth links.

7. A suspension system as claimed in claim 2 wherein at least one of said variable length supports is connected between the first hull and one of the first, second, third or fourth links.

8. A suspension system as claimed in claim 1 wherein each of said respective first, second, third and fourth links is connected to the chassis by a respective first, second, third and fourth chassis joint and is connected to the hull by a respective first, second, third and fourth hull joint.

9. A suspension system as claimed in claim 8 wherein at least one of said chassis or hull joints provides substantially linear motion constraints and permits at least limited rotational motion.

10. A suspension system as claimed in claim 8 wherein each of said four links includes a chassis joint and a hull joint.

11. A suspension system as claimed in claim 8 wherein two chassis joints of the first, second, third or fourth chassis joints are combined or wherein the fourth hull joint and one of the first, second or third hull joints are combined.

12. A suspension system as claimed in claim 8 wherein the hull joint of the fourth link is fixed to one of the first, second or third links or wherein the chassis joint of one of the first, second or third links is fixed to the fourth link.

13. A suspension system as claimed in claim 8 wherein at least one of the first, second and third hull joints connect the respective link to an up-stand projecting above the first hull.

14. A suspension system as claimed in claim 8 wherein the third link is longitudinally spaced between the first and second links.

15. A suspension system as claimed in claim 8 wherein the fourth link is positioned nearer to the bow of the first hull than the stern of the first hull, the fourth hull joint of the fourth link being forward of the fourth chassis joint of the fourth link.

16. A suspension system as claimed in claim 8 wherein the fourth link is positioned nearer to the stern of the first hull than the bow of the first hull, the fourth hull joint of the fourth link being rearward of the fourth chassis joint of the fourth link.

17. A suspension system as claimed in claim 1 wherein a length of the third link is different from a length of the first and/or second link to adjust the roll attitude of the hull relative to the chassis as the hull is displaced vertically relative to the chassis.

18. A suspension system as claimed in claim 1 wherein the fourth link is connected directly or indirectly to the chassis by a fourth chassis joint and is connected directly or indirectly to the hull by a fourth hull joint, the fourth chassis joint being above the fourth hull joint at a ride height.

19. A suspension system as claimed in claim 1 wherein the fourth link includes a length adjustment device for adjusting the length of the fourth link between a fourth chassis joint and a fourth hull joint, or wherein the fourth link is length adjustable by a length adjustment device such that a straight line distance between the fourth chassis joint and the fourth hull joint may be adjusted.

20. A suspension system as claimed in claim 19 wherein the length adjustment device is adjustable between a wide hull spacing position and a narrow hull spacing position where in the wide hull spacing position the first hull is spaced further away from a centre-line of the chassis than in the narrow hull spacing position.

21. A suspension system as claimed in claim 20 wherein in the wide hull spacing position at least one of the first, second or third links also extend in a longitudinal direction relative to the chassis.

22. A suspension system as claimed in claim 20 wherein in the narrow hull spacing position at least one of the first, second or third links also extend in a longitudinal direction relative to the chassis.

23. A suspension system as claimed in claim 20 wherein first supports are arranged between the chassis and the first hull or any of the first, second, third or fourth links, each support being effectively connected to the chassis by a chassis mounting point and effectively connected to the hull by a hull mounting point on the first hull or on any of the first, second third or fourth links, the chassis and hull mounting points being arranged such that when adjusting the length adjustment device of the fourth link from the wide hull spacing position to the narrow hull spacing position, an inclination of each support is increased, reducing a vertical support force relative to the chassis so that a height of the chassis relative to the hulls is reduced.

24. A suspension system as claimed in claim 19 wherein the fourth link also extends in a lateral direction relative to the chassis.

25. A suspension system as claimed in claim 1 wherein the fourth link of the first hull locating arrangement is length adjustable and wherein adjusting a length of the fourth link displaces the first hull laterally and longitudinally relative to the chassis.

26. A water craft including the suspension system of claim 1.

27. A multi-hulled vessel or water craft including a chassis, two moveable hulls and a suspension system, the suspension system including a respective hull locating arrangement for each respective moveable hull to provide linear and rotational constraints on motion of the hull relative to the chassis, wherein one or each of the respective hull locating arrangements comprises four links, each link being connected directly or indirectly between the respective hull and the chassis, the four links consisting of a first, second, third and fourth link, each link having a chassis joint between the link and the chassis and a hull joint between the link and the hull or one of the other of the four links, the first and second links each extending in at least a lateral direction relative to the chassis, the second link being longitudinally spaced from the first link relative to the chassis, at least the fourth link extending in at least a longitudinal direction, the fourth link providing a longitudinal constraint on motion of the respective hull relative to the chassis, the first second and third links adding a lateral, a yaw and a roll constraint on motion of the respective hull relative to the chassis, such that pitch and heave motions of the respective hull relative to the chassis are not constrained.

* * * * *